US012114738B1

(12) United States Patent
DeVard

(10) Patent No.: US 12,114,738 B1
(45) Date of Patent: Oct. 15, 2024

(54) ADJUSTABLE ALTERATION TACK ASSEMBLY

(71) Applicant: Danielle DeVard, Philadelphia, PA (US)

(72) Inventor: Danielle DeVard, Philadelphia, PA (US)

( * ) Notice: Subject to any disclaimer, the term of this patent is extended or adjusted under 35 U.S.C. 154(b) by 22 days.

(21) Appl. No.: 18/307,739

(22) Filed: Apr. 26, 2023

(51) Int. Cl.
*A44B 1/36* (2006.01)

(52) U.S. Cl.
CPC ..... *A44B 1/36* (2013.01)

(58) Field of Classification Search
CPC .... A44B 1/36; A44B 1/26; A44B 9/06; A44B 9/04; Y10T 24/4679; Y10T 24/4696; Y10T 24/4627; Y10T 24/3681; Y10T 24/3685; Y10T 24/3649
See application file for complete search history.

(56) References Cited

U.S. PATENT DOCUMENTS 929,149 A * 7/1909 Martens ..... A44B 1/28 24/707.5
1,036,088 A * 8/1912 Fortescue ..... A44B 1/40 24/710.4
1,043,027 A * 10/1912 Newman ..... A44B 1/40 24/710.4
1,400,147 A * 12/1921 Fitzpatrick ..... A42B 7/00 132/71.1

FOREIGN PATENT DOCUMENTS

EP 1348349 A1 10/2003

* cited by examiner

*Primary Examiner* — Robert Sandy
(74) *Attorney, Agent, or Firm* — Mendelsohn Dunleavy, P.C.; Steve Mendelsohn

(57) ABSTRACT

An adjustable alteration tack assembly has (i) a tack with a hollow pin and (ii) a cap with a hole that receives the tack pin to assemble the cap onto the tack. The tack has a posted permanently mounted onto a head, where the post can be inserted into the hollow pin at different positions to achieve different distances between the tack head and the cap to secure pieces of fabric of different thicknesses. The assembly can be used to temporarily alter the size of an article of clothing, such as the waistband of a pair of pants.

11 Claims, 9 Drawing Sheets

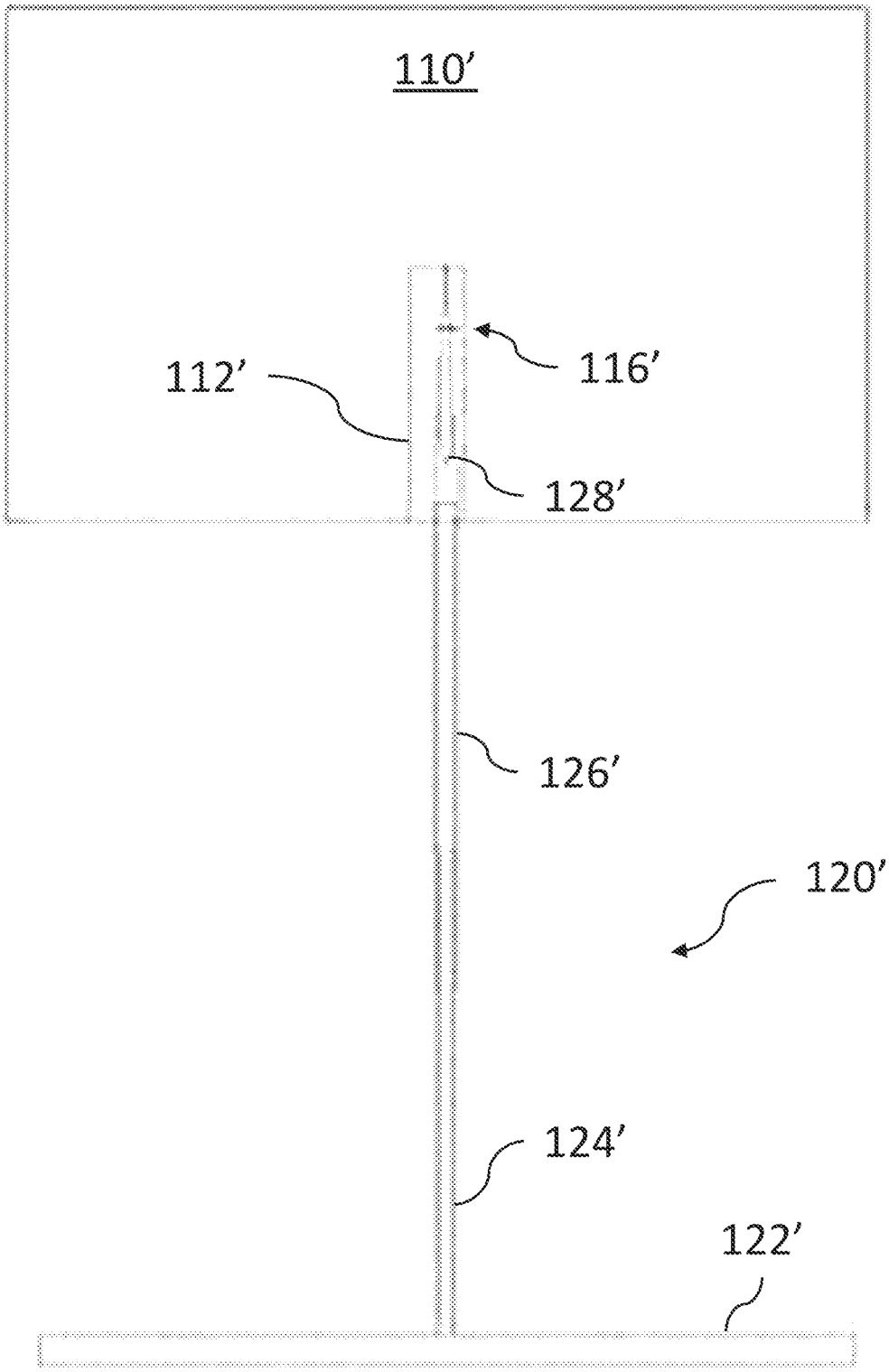
FIG. 6 100'

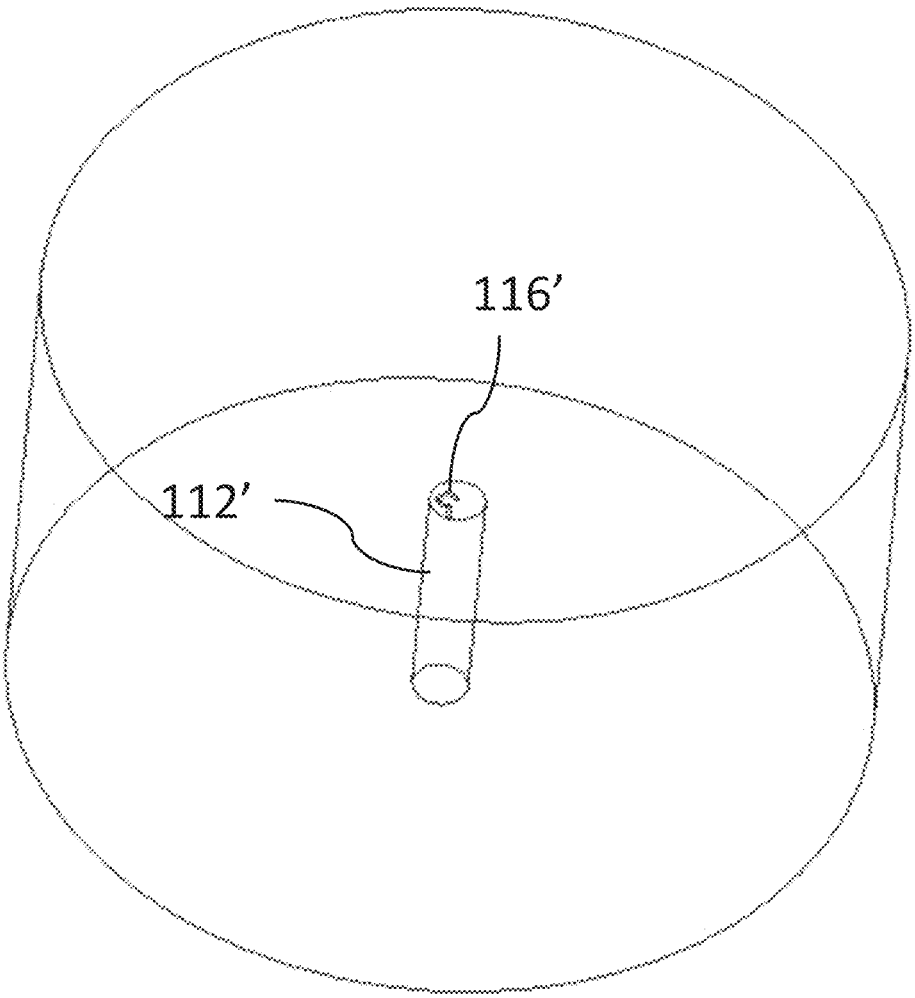
FIG. 7 110'

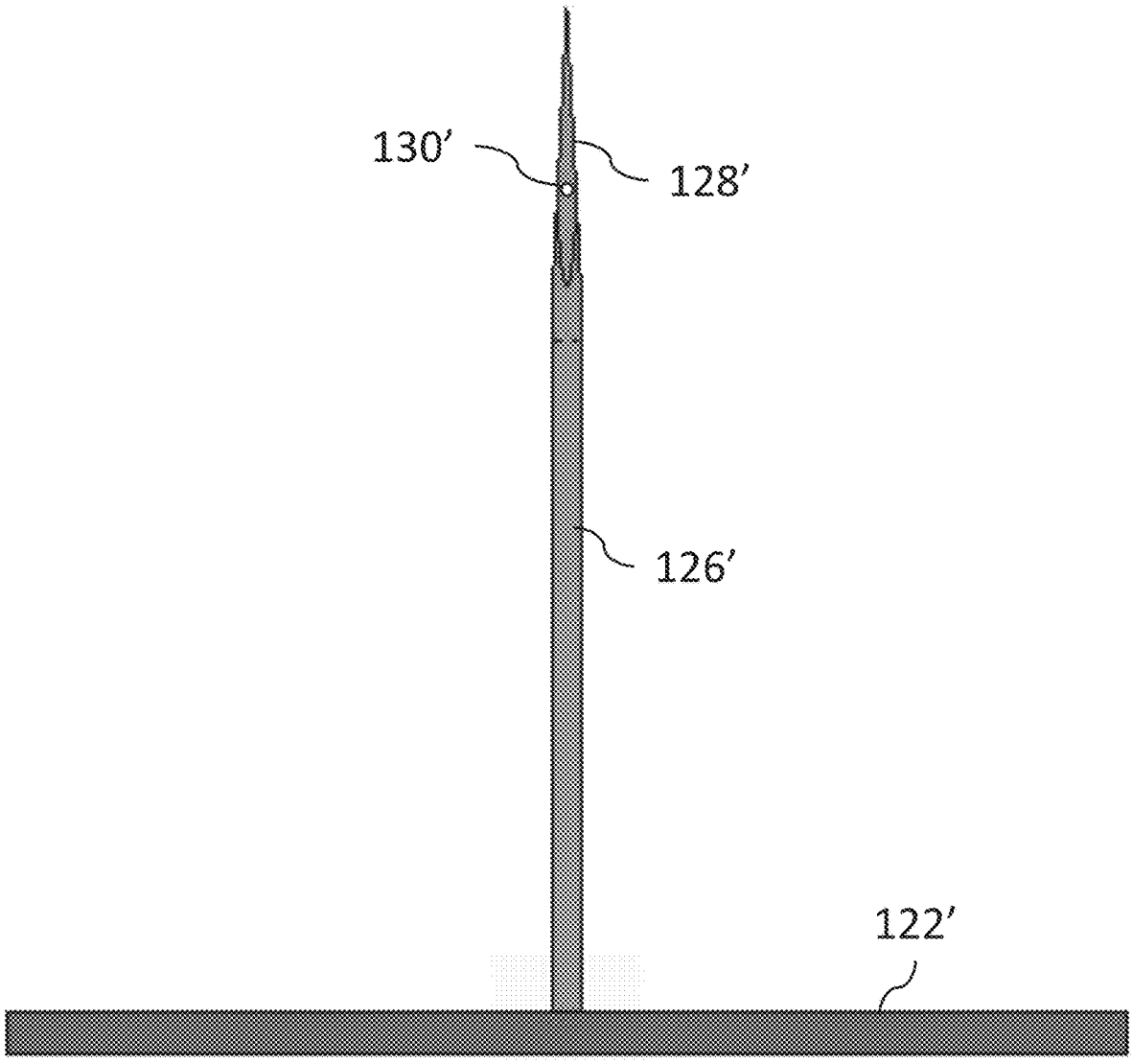
FIG. 8 120'

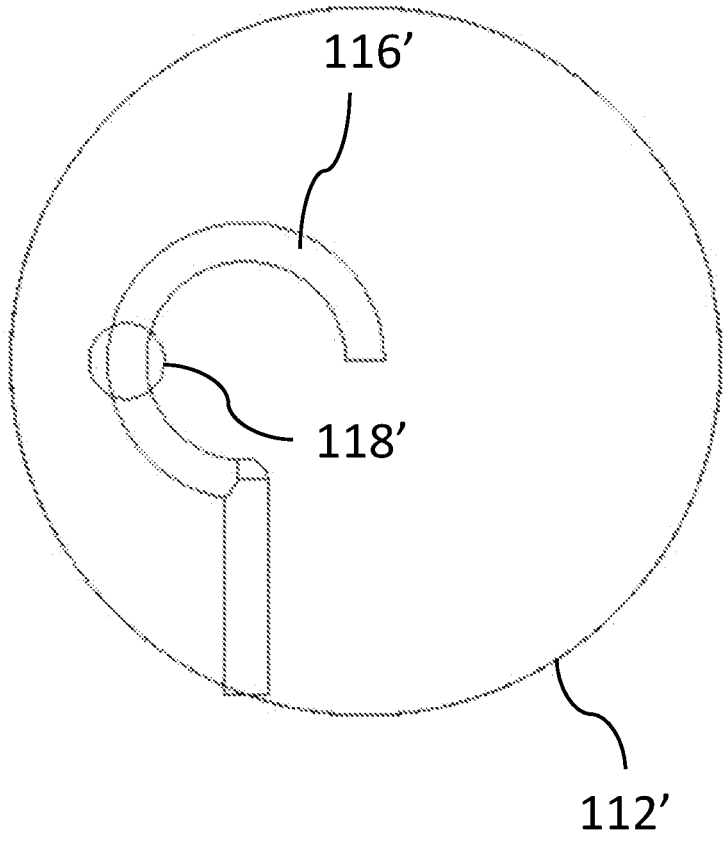
FIG. 9 110'

ADJUSTABLE ALTERATION TACK ASSEMBLY

BACKGROUND

Field of the Disclosure

The present disclosure relates to clothing accessories and, more specifically but not exclusively, to devices for temporarily altering the size of clothing, such as pant waist size.

Description of the Related Art

This section introduces aspects that may help facilitate a better understanding of the disclosure. Accordingly, the statements of this section are to be read in this light and are not to be understood as admissions about what is prior art or what is not prior art.

When a piece of clothing is too big for a user, it is often useful to temporarily alter the size of the clothing for the user. For example, if the waist size of a pair of pants is too big, then the waist size can be temporarily altered by pinching some of the fabric together such that the fabric overlaps with itself and then securing the folded fabric using a known device, such as a safety pin or a bobby pin or a clip.

SUMMARY

The present disclosure provides an adjustable device for temporarily altering the size of clothing.

BRIEF DESCRIPTION OF THE DRAWINGS

Embodiments of the disclosure will become more fully apparent from the following detailed description, the appended claims, and the accompanying drawings in which like reference numerals identify similar or identical elements.

FIG. 6 is a cross-sectional side view of an adjustable alteration tack assembly according to certain alternative embodiments of the present disclosure;

FIG. 7 is a perspective, X-ray view of the cap of FIG. 6;

FIG. 8 is a side view of the tack of FIG. 6; and

FIG. 9 is a zoomed-in view of the hook mounted in the hole of the cap of FIG. 6.

DETAILED DESCRIPTION

Detailed illustrative embodiments of the present disclosure are disclosed herein. However, specific structural and functional details disclosed herein are merely representative for purposes of describing example embodiments of the present disclosure. The present disclosure may be embodied in many alternate forms and should not be construed as limited to only the embodiments set forth herein. Further, the terminology used herein is for the purpose of describing particular embodiments only and is not intended to be limiting of example embodiments of the disclosure.

As used herein, the singular forms "a," "an," and "the," are intended to include the plural forms as well, unless the context clearly indicates otherwise. It further will be understood that the terms "comprises," "comprising," "contains," "containing," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functions/acts involved.

Figure 1:
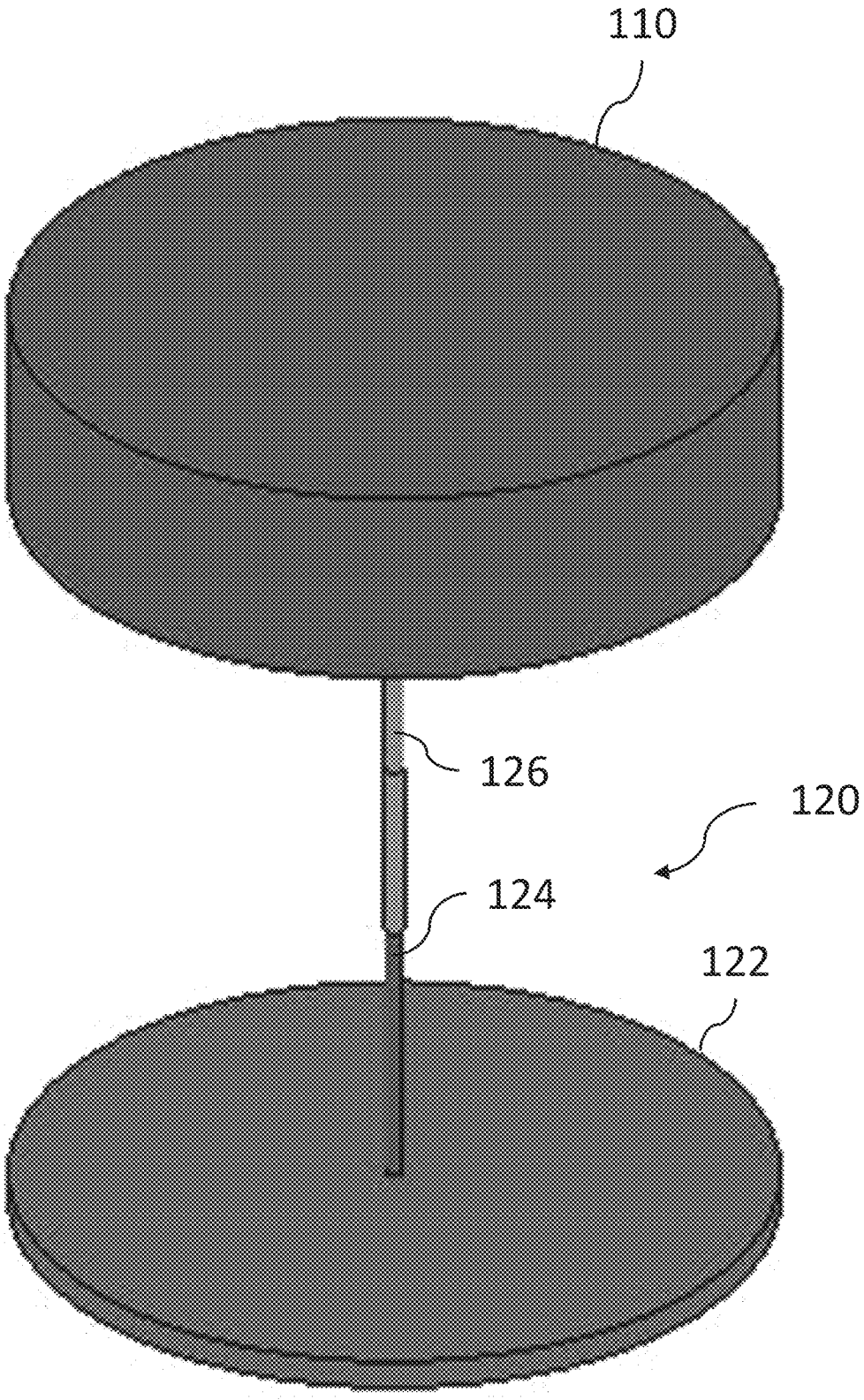
FIG. 1 is a perspective view of an adjustable alteration tack assembly according to certain embodiments of the present disclosure.
Figure 2:
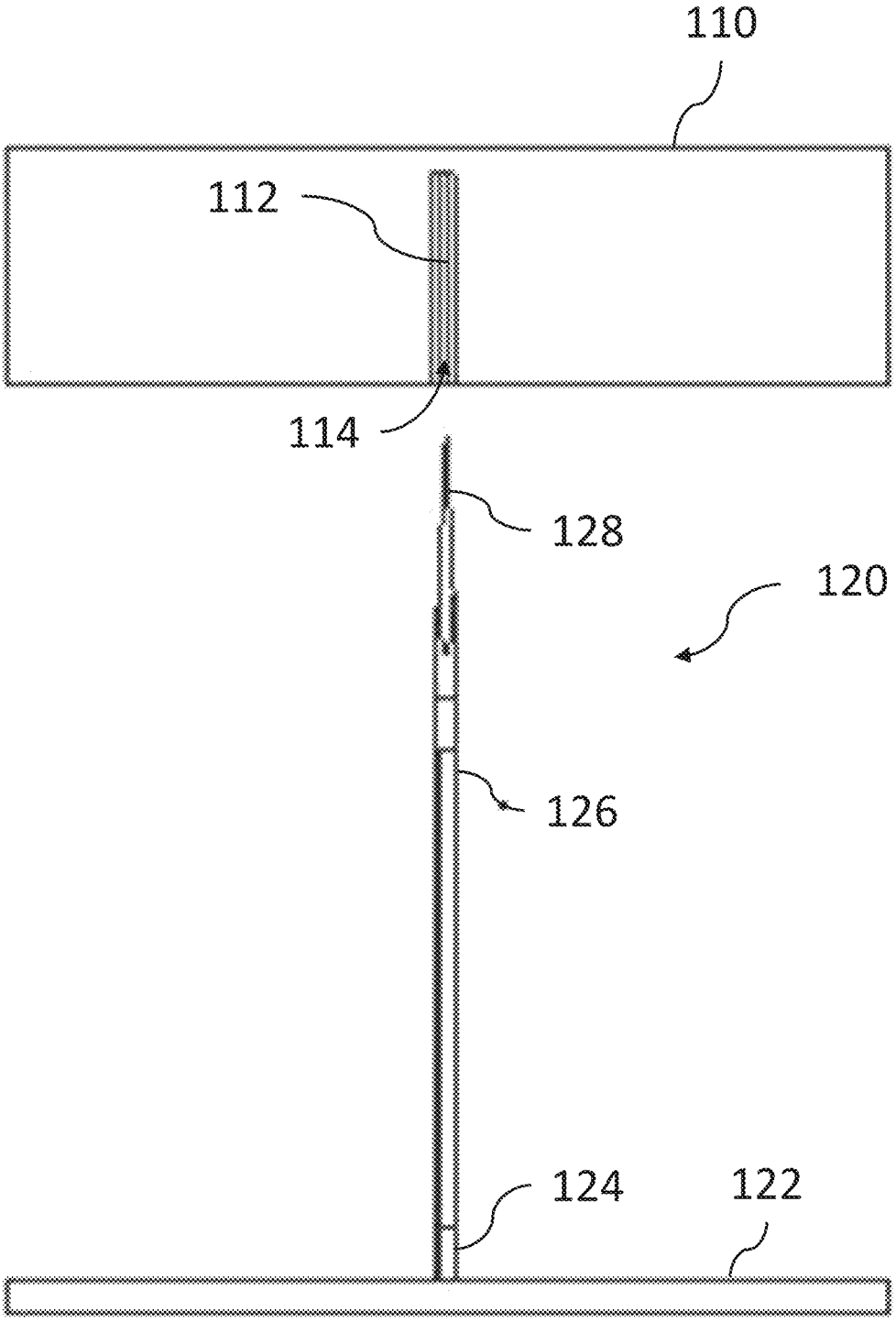
FIG. 2 is an X-ray side view of the assembly of FIG. 1 in a disengaged (i.e., unassembled) configuration.

FIG. 1 is a perspective view of an adjustable alteration tack assembly 100 according to certain embodiments of the present disclosure. FIG. 2 is an X-ray side view of the assembly 100 of FIG. 1 in a disengaged (i.e., unassembled) configuration. Assembly 100 includes a short, cylindrical "female" part (aka cap) 110 that receives a "male" part (aka tack) 120. The cap 110 has a cylindrical hole 112 having a circular opening 114. The tack 120 includes a flat, circular head 122, a solid, cylindrical post 124, and a hollow, cylindrical pin 126 having a sharp pointed end 128. The post 124 is permanently affixed to the center of the head 122, and the hollow pin 126 slidably receives the solid post 124 with a friction fit between the two which keeps the pin 126 in place at a position along the post 124. The pin 126 can be moved up and down on the post 124 with the application of appropriate force, e.g., about 5 pounds in some implementations, to change of position of the pin 126 along the post 124. In the view of FIG. 2, the post 124 is only partially inserted into the pin 126.

Although the cap 110 is cylindrical and the tack head 122 is circular, in other embodiments, other shapes are possible, such as rectilinear and/or other polygonal shapes for the cap and/or tack head. The hollow pin 126 may be similar to a hollow sewing machine needle or a hollow hospital needle.

The cap 110 and the tack 120 can be engaged by inserting the pointed end 128 of the pin 126 of the assembled tack 120 through the opening 114 and into the hole 112 in the cap 110. The cylindrical hole 112 in the cap 110 and the pin 126 have features that enable the pin 126 to be removably secured within the hole 112. In some implementations, these features may be similar to those on the posts and backs of conventional two-piece earrings.

Figure 3:
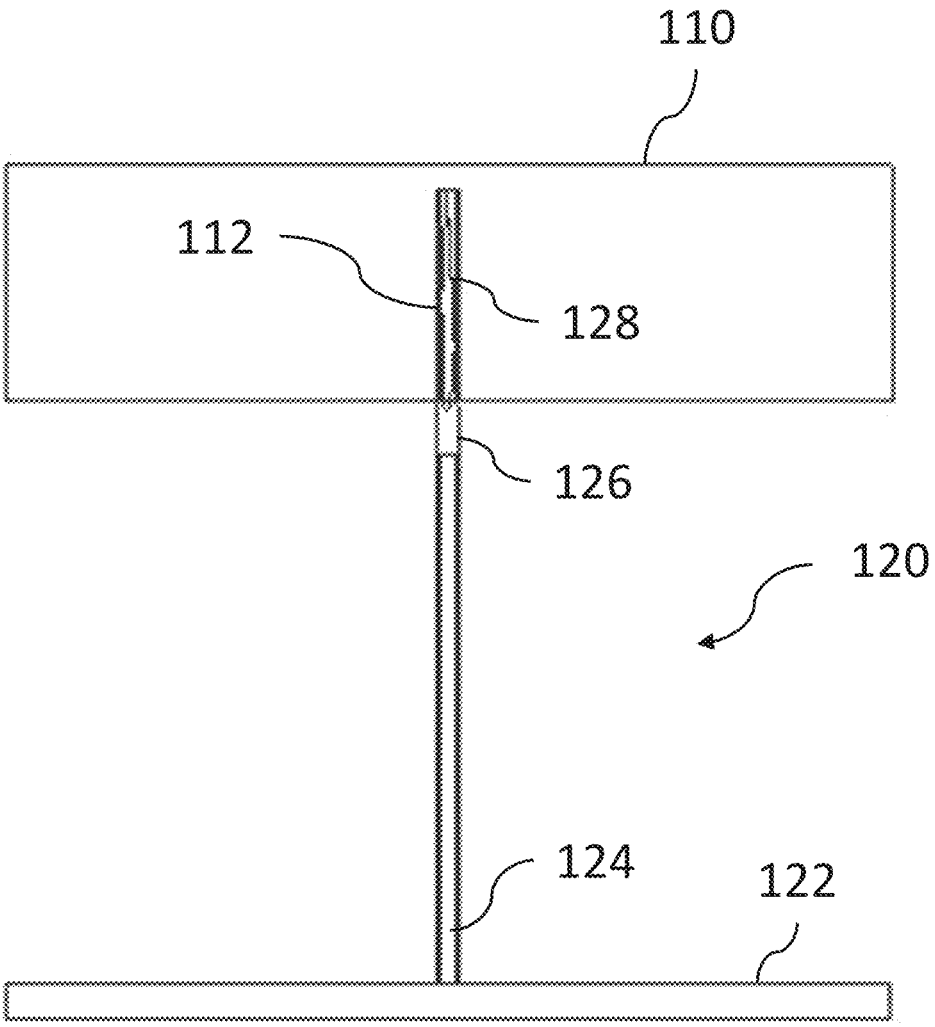
FIG. 3 is an X-ray side view of the assembly of FIG. 1 (i) with the post fully inserted into the pin and (ii) with the pointed end of the pin fully inserted into the cap hole.

FIG. 3 is an X-ray side view of the assembly 100 of FIG. 1 (i) with the post 124 fully inserted into the pin 126 such that the lower end of the hollow pin 126 abuts the tack head 122 and (ii) with the pointed end 128 of the pin 126 fully inserted into the hole 112 of the cap 110. With the post 124 fully inserted into the pin 126, the assembly 100 is configured at the shortest available distance between the bottom of the cap 110 and the tack head 122. In some embodiments, this distance is about 0.125 inches. Other embodiments may have larger or smaller distances. The position of the pin 126 with respect to the post 124 can be adjusted (for example, as shown in FIG. 2) to achieve distances between the bottom of the cap 110 and the tack head 122 from the smallest distance up to about 0.5 inches.

Figure 4:
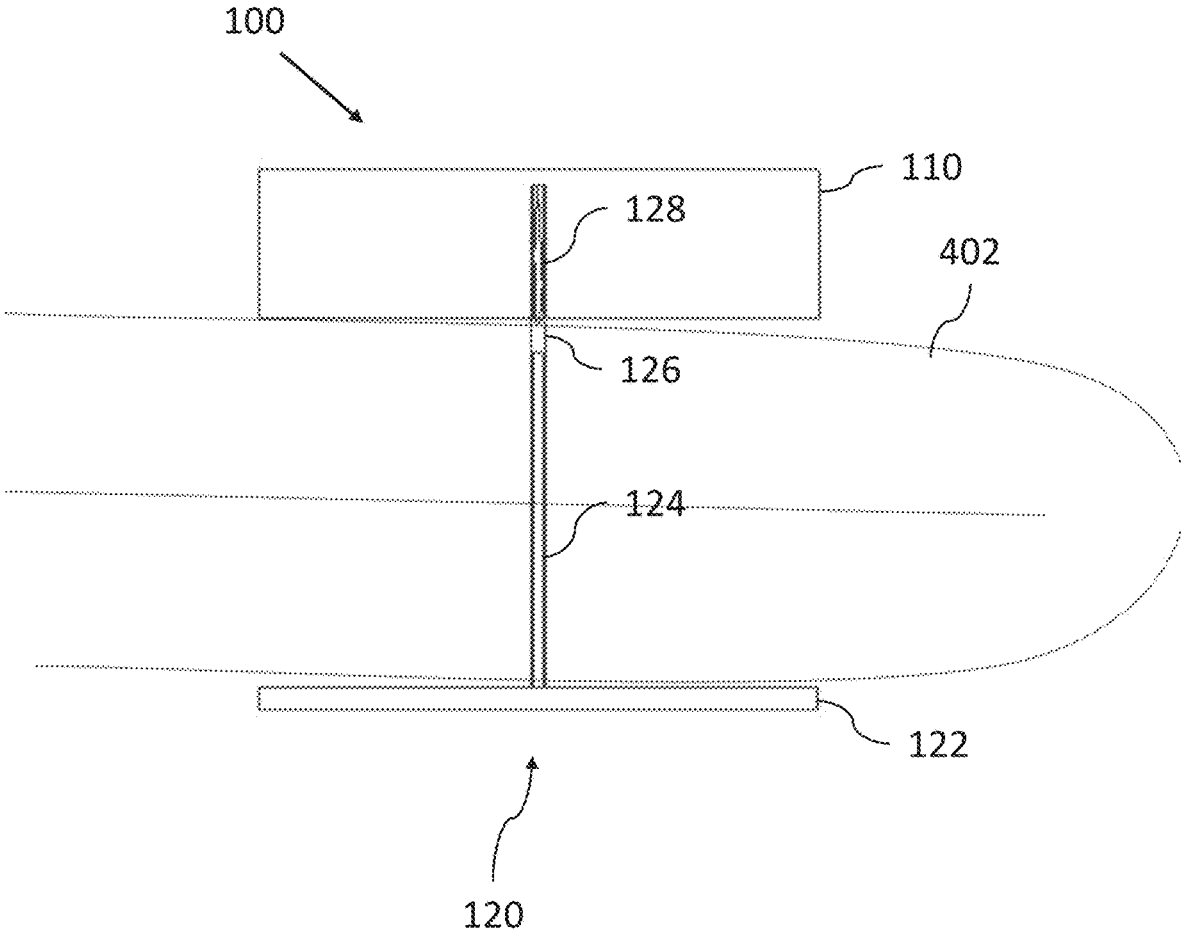
FIG. 4 is an X-ray side view of the fully assembled assembly of FIG. 1 securing together a folded piece of relatively thin fabric.

FIG. 4 is an X-ray side view of the fully assembled assembly 100 of FIG. 1 securing together a folded piece of relatively thin fabric 402 of an article of clothing. For example, the fabric 402 could be part of the waistband of a pair of pants. Because the fabric 402 is relatively thin, the assembly 100 is configured with the post 124 fully inserted into the pin 126, thereby providing the smallest available distance between the bottom of the cap 110 and the tack head 122.

In one scenario, the post 124 is initially fully inserted into the pin 126. The pin 126 is then inserted through the folded fabric 402 such that the pointed end 128 of the pin 126 extends beyond the folded fabric 402. The cap 110 is then placed onto the pointed end 128 of the pin 126, thereby securing the folded fabric 402 in place and temporarily altering the size of the article of clothing.

In another scenario, the post 124 is initially only partially inserted into the pin 126. The pin 126 is then inserted through the folded fabric 402 such that the pointed end 128 of the pin 126 extends beyond the folded fabric 402. The cap 110 is then placed onto the pointed end 128 of the pin 126 and sufficient pressure is applied between the cap 110 and the tack head 122, such that the post 124 slides fully into the pin 126, thereby achieving the configuration of FIG. 3 with the folded fabric 402 secured in place and the size of the article of clothing temporarily altered.

Figure 5:
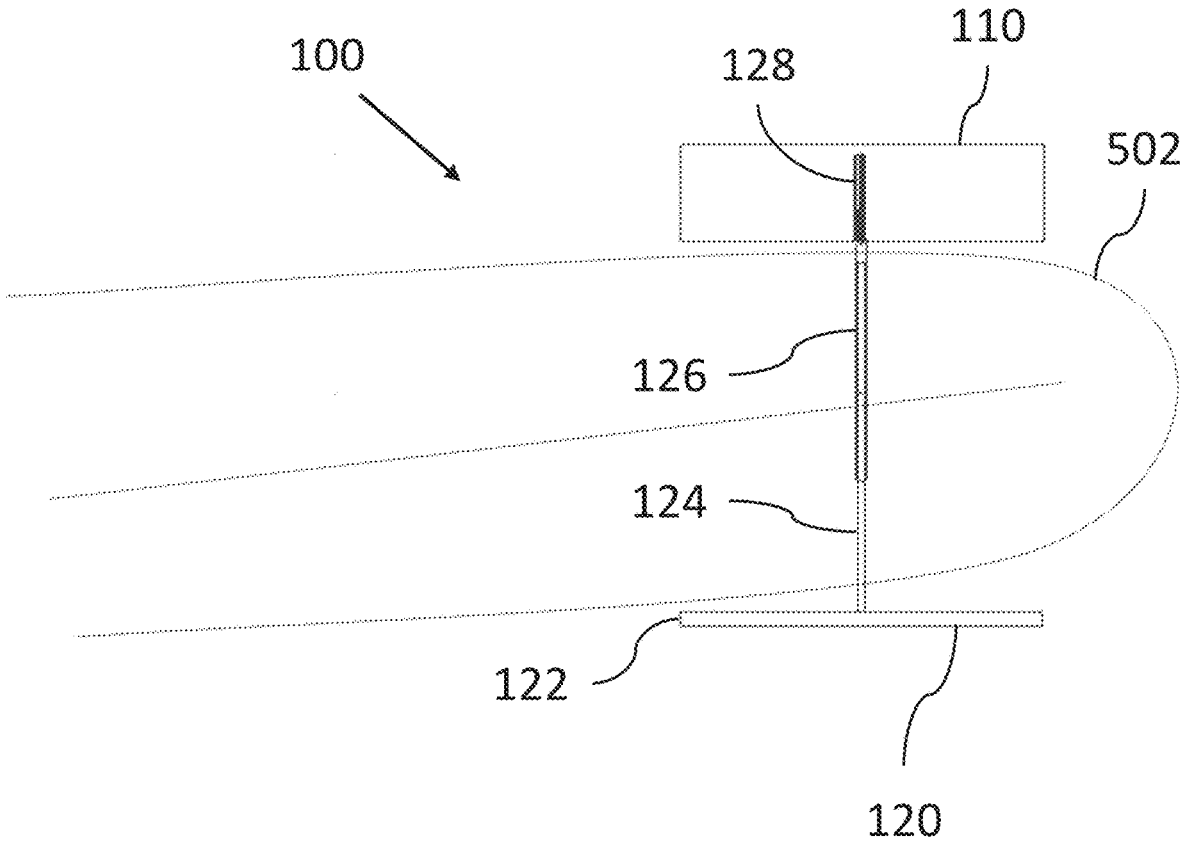
FIG. 5 is an X-ray side view of the fully assembled assembly of FIG. 1 securing together a folded piece of relatively thick fabric.

FIG. 5 is an X-ray side view of the fully assembled assembly 100 of FIG. 1 securing together a folded piece of relatively thick fabric 502 of an article of clothing. Because the fabric 502 is relatively thick, the assembly 100 is configured with the post 124 only partially inserted into the pin 126, thereby providing a larger distance between the bottom of the cap 110 and the tack head 122 than the distance in FIGS. 3 and 4.

In one scenario for achieving the configuration of FIG. 5, the post 124 is only slightly inserted into the pin 126. The pin 126 is then inserted through the folded fabric 502 such that the pointed end 128 of the pin 126 extends at least a little beyond the folded fabric 502. The cap 110 is then placed onto the pointed end 128 of the pin 126 and, if necessary, pressure may be applied between the cap 110 and the tack head 122, such that the post 124 may slide further into the pin 126, thereby decreasing the distance between the bottom of the cap 110 and the tack head 122, securing the folded fabric 502 in place, and temporarily altering the size of the article of clothing.

In some embodiments, (i) the cap 110 and (ii) the head 122 and the pin 126 of the tack 120 are made of suitable metal(s), while the post 124 of the tack 120 is made of a suitable rubber. Other suitable materials may also be possible. The post 124 may be permanently secured to the head 122 by transfer molding, where the metal and rubber are welded together using heat.

Although the disclosure has been described in the context of a hollow pin that slidably receives a post with a friction fit therebetween, other embodiments are also possible. For example, the opening in the hollow pin could be tapped and the post could be correspondingly threaded such that the pin can be adjustably mounted onto the post at different positions to achieve different distances between the tack head and the cap by screwing the pin ono the post.

Similarly, although the disclosure has been described in the context of a cap that slidably receives the pointed end of a pin, other embodiments are also possible. For example, the hole in the cap could be tapped and the pointed end of the pin could be correspondingly threaded such that the cap can be mounted onto the tack pin by screwing the cap onto the tack pin.

FIG. 6 is a cross-sectional side view of an adjustable alteration tack assembly 100' according to certain alternative embodiments of the present disclosure. In this alternative, the pointed end 128' of the pin 126' of the tack 120' has a hole 130' (similar to the hole in a sewing needle) that engages with a hook 116' near the top end of the hole 112' in the cap 110' to secure the cap 110' and the tack 120' together. The assembly 100' is assembled by inserting the pointed end 128' of the pin 126' into the hole 112' in the cap 110' up to the hook 116' and then rotating the cap 110' with respect to the tack 120' to insert the open end of the hook 116' into the hole 130'.

FIG. 7 is a perspective, X-ray view of the cap 110' of FIG. 6 having the hook 116' near the top end of the hole 112', and FIG. 8 is a side view of the tack 120' of FIG. 6 showing the hole 130' at the pointed end 128' of the pin 126'.

FIG. 9 is a zoomed-in view of the hook 116' mounted in the hole 112' of the cap 110' of FIG. 6. As shown in FIG. 9, the hook 116' has a sphere of flexible material 118' that has a diameter slightly larger than the diameter of the hole 130' in the pin 126'. When the hook 116' is rotated into the hole 130' in the pin 126', the flexible material 118' is forced through the hole 130' to secure the cap 110' onto the tack 120'. In some implementations, the hook 116' is metal, the flexible material 118' is silicon, and it takes about 0.2 pounds of force to force the flexible material 118' through the hole 130'.

In certain embodiments of the present disclosure, an adjustable assembly comprising (i) a cap (e.g., 110) having a hole (e.g., 112) and (ii) a tack (e.g., 120) having a head (e.g., 122), a post (e.g., 124) permanently attached to the head, a hollow pin (e.g., 126) configured to receive the post at one end of the pin and to be inserted into the hole in the cap at another end of the pin to secure the tack onto the cap. The pin can be mounted onto the post at different positions to achieve different distances between the cap and the tack head.

In at least some of the above embodiments, the pin slidably receives the post with a friction fit between the pin and the post that secures the mounting of the pin onto the post at a given position.

In at least some of the above embodiments, the position of the post within the pin can be slidably adjusted by applying sufficient force between the pin and the post to overcome the friction fit.

In at least some of the above embodiments, the pin is made of metal and the post is made of rubber.

In at least some of the above embodiments, the pin can be fully mounted onto the post to achieve a relatively small distance between the cap and the tack head to secure relatively thin fabric, and the pin can be partially mounted onto the post to achieve a relatively large distance between the cap and the tack head to secure relatively thick fabric.

In at least some of the above embodiments, the cap has a hook within the hole, and the pin of the tack has a hole configured to engage with the hook to secure the cap onto the tack.

In at least some of the above embodiments, the hook has flexible material that is slightly larger than the hole in the pin and that is configured to secure the cap onto the tack when the flexible material is forced through the hole in the pin.

The assembly can be used to temporarily secure fabric by (i) adjusting the position of the pin mounted onto the post; (ii) inserting the pin through the fabric; and (iii) mounting the cap onto the pin to secure the fabric in place. Pressure can be applied between the cap and the head of the tack to slidably adjust the position of the pin mounted onto the post to decrease the distance between the cap and the tack head to secure the fabric in place.

Unless explicitly stated otherwise, each numerical value and range should be interpreted as being approximate as if the word "about" or "approximately" preceded the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence. Likewise, additional steps may be included in such methods, and certain steps may be omitted or combined, in methods consistent with various embodiments of the disclosure.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements. The same type of distinction applies to the use of terms "attached" and "directly attached," as applied to a description of a physical structure. For example, a relatively thin layer of adhesive or other suitable binder can be used to implement such "direct attachment" of the two corresponding components in such physical structure.

The described embodiments are to be considered in all respects as only illustrative and not restrictive. In particular, the scope of the disclosure is indicated by the appended claims rather than by the description and figures herein. All changes that come within the meaning and range of equivalency of the claims are to be embraced within their scope.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

While preferred embodiments of the disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the technology of the disclosure. It is intended that the following claims define the scope of the invention and that methods and structures within the scope of these claims and their equivalents be covered thereby.

What is claimed is:

1. An adjustable assembly comprising:

a cap having a hole; and a tack having a head, a post permanently attached to the head, a hollow pin configured to receive the post at one end of the pin and to be inserted into the hole in the cap at another end of the pin to secure the tack onto the cap, wherein the pin can be mounted onto the post at different positions to achieve different distances between the cap and the tack head, wherein the pin is made of metal and the post is made of rubber.

2. The assembly of claim 1, wherein the pin slidably receives the post with a friction fit between the pin and the post that secures the mounting of the pin onto the post at a given position.

3. The assembly of claim 2, wherein the position of the post within the pin can be slidably adjusted by applying sufficient force between the pin and the post to overcome the friction fit.

4. The assembly of claim 1, wherein:

the pin can be fully mounted onto the post to achieve a relatively small distance between the cap and the tack head to secure relatively thin fabric; and the pin can be partially mounted onto the post to achieve a relatively large distance between the cap and the tack head to secure relatively thick fabric.

5. The assembly of claim 1, wherein:

the cap has a hook within the hole; and the pin of the tack has a hole configured to engage with the hook to secure the cap onto the tack.

6. The assembly of claim 5, wherein the hook has flexible material that is slightly larger than the hole in the pin and that is configured to secure the cap onto the tack when the flexible material is forced through the hole in the pin.

7. A method for temporarily securing fabric using an adjustable assembly comprising (i) a cap having hole and (ii) a tack having a head, a post permanently attached to the head, a hollow pin configured to receive the post at one end of the pin and to be inserted into the hole in the cap at another end of the pin to secure the tack onto the cap, wherein the pin can be mounted onto the post at different positions to achieve different distances between the cap and the tack head, the method comprising:

adjusting the position of the pin mounted onto the post;

inserting the pin through the fabric;

mounting the cap onto the pin to secure the fabric in place; and applying pressure between the cap and the head of the tack to slidably adjust the position of the pin mounted onto the post to decrease the distance between the cap and the tack head to secure the fabric in place.

8. An adjustable assembly comprising:

a cap having a hole; and a tack having a head, a post permanently attached to the head, a hollow pin configured to receive the post at one end of the pin and to be inserted into the hole in the cap at another end of the pin to secure the tack onto the cap, wherein the pin can be mounted onto the post at different positions to achieve different distances between the cap and the tack head, wherein:

the cap has a hook within the hole;

the pin of the tack has a hole configured to engage with the hook to secure the cap onto the tack; and the hook has flexible material that is slightly larger than the hole in the pin and that is configured to secure the cap onto the tack when the flexible material is forced through the hole in the pin.

9. The assembly of claim 8, wherein the pin slidably receives the post with a friction fit between the pin and the post that secures the mounting of the pin onto the post at a given position.

10. The assembly of claim 9, wherein the position of the post within the pin can be slidably adjusted by applying sufficient force between the pin and the post to overcome the friction fit.

11. The assembly of claim 8, wherein:

the pin can be fully mounted onto the post to achieve a relatively small distance between the cep and the tack head to secure relatively thin fabric; and the pin can be partially mounted onto the post to achieve a relatively large distance between the cap and the tack head to secure relatively thick fabric.

* * * * *